United States Patent [19]

Rathert

[11] 4,275,873

[45] Jun. 30, 1981

[54] PROCESS AND EQUIPMENT FOR THE OPENING OF FOLDED PROOF SHEETS

[75] Inventor: Horst Rathert, Minden, Fed. Rep. of Germany

[73] Assignee: Rahdener Maschinenfabrik August Kolbus, Wesphalia, Fed. Rep. of Germany

[21] Appl. No.: 52,684

[22] Filed: Jun. 27, 1979

[30] Foreign Application Priority Data

Jul. 1, 1978 [DE] Fed. Rep. of Germany ..... 2829067

[51] Int. Cl.[3] ..... B65H 39/02

[52] U.S. Cl. ..... 270/54; 493/450

[58] Field of Search ..... 270/54–56, 270/69; 271/197

[56] References Cited

U.S. PATENT DOCUMENTS

| | | | |
|---|---|---|---|
| Re. 22,359 | 8/1943 | Christensen | 270/55 |
| 2,772,880 | 12/1956 | Garrett | 271/197 |
| 3,661,379 | 5/1972 | Dolfini | 270/54 |

FOREIGN PATENT DOCUMENTS

| | | | |
|---|---|---|---|
| 396816 | 8/1933 | United Kingdom | 270/54 |

*Primary Examiner*—Edward M. Coven
*Assistant Examiner*—A. Heinz
*Attorney, Agent, or Firm*—Fishman and Van Kirk

[57] ABSTRACT

A process for opening folded proof sheets, particularly for their positioning on the conveyor plate of a thread stitching machine, involves moving a stack of the proof sheets along devices which separate the individual sheets until they reach the point where they are all opened. The separating devices comprise blown air suction plates which cause the free outer corner of the adjacent sheet to be drawn up by the suction effect of air jets and thus separated from the rest of the stack. The portion of the sheet which was separated is then guided away from the next blown air suction plate to permit the next proof sheet to be opened.

15 Claims, 3 Drawing Figures

PROCESS AND EQUIPMENT FOR THE OPENING OF FOLDED PROOF SHEETS

BACKGROUND OF THE INVENTION (1) Field of the Invention

This invention concerns a process and the equipment for the opening of folded proof sheets so as to enable their positioning on the conveyor plate of a thread stitching machine. A "signature" or stack of the proof sheets is moved along devices which serially separate portions of the individual sheets from the stack and the individual sheets are subsequently opened.

(2) Description of the Prior Art

The equipment presently known for the opening of folded layers of proof sheets, as exemplified by the disclosure of German Patent Publication No. 1,099,988, is a device with a conveyor belt beneath it on which a proof sheet is transported in its closed state. On either side of the conveyor belt is a pair of cylindrical suction rolls and beyond these suction rolls, in the direction of transport, is another pair of cylindrical suction rolls. Between the pairs of suction rolls are proof sheet diverters which form the transition from the vertical transport area of the first pair of suction rolls to the slanted mantle area of the second pair of suction rolls which guide the outer edges of the sheets, which were gripped by the first pair of suction rolls, to the area behind the proof sheet diverters. During further transport, the sheets are moved away from the effect of the second pair of suction rolls through the use of the proof sheet diverter and subsequent sheets are gripped and guided over further proof sheet diverters until the proof sheets thus opened are fed to the collating plate of another machine.

In order to open three or more single sheets which have been folded and inserted into one another, the required number of pairs of suction rolls can be arranged and connected with each other by proof sheet diverters.

Automatic programming permits starting and stopping the individual suction rolls in a predetermined sequence.

The device described and illustrated in aforementioned German Patent Publication No. 1,099,988 for the opening of folded layers of sheets is unsatisfactory in that it does not permit the opening of all kinds of layers. For instance, if the stack consists of sheets with square folding, e.g., if the layers are partially closed at the top or bottom, the suction rolls and proof sheet diverters cannot be guided through them. While it is in some cases possible to open squarely folded stacks on one side by guiding such stacks over suction rolls and proof sheet dividers of the type disclosed in German Patent Publication No. 1,099,988, the full opening of such a stack is possible only if the machine to which the sheets are fed has a cooperating feeding edge. This machine could, for instance, be a thread stitching machine and the feeding edge could either be located at its front or its back, depending upon the model.

However, practical experience has shown that one cannot open a great number of square folded layers with the device described in German Patent Publication No. 1,099,988.

Furthermore, the suction rolls used in the device of German Patent Publication No. 1,099,988 are not capable of processing every kind of paper. Due to the strong suction effect, several sheets tend to be sucked up at one time when porous paper is used, thus leading to significant problems in the production process.

German Pat. No. 1,945,501 discloses a device for the central opening of proof sheets which are folded at right angles wherein a sheet mover is fashioned as a conveyor belt which is positioned along a number of rotating suction devices, all the way to the opening area, for the lifting and turning of the free portions of the sheets not held by the conveyor belt. The apparatus of this patent also employs grippers which grip also the main fold of the free edge of the lower half of the opened proof sheet. The controlling of the suction effect can be done either by a photoelectric light barrier or by automatic programming. At the end of the conveyor belt, the proof sheets are put onto a collating plate such as that of the thread stitching machine whereby the free sections of the sheets, which are not being held by the conveyor belt, are held up by a guide plate.

The apparatus of German Pat. No. 1,945,501 can be used to open any conceivable layer of paper at the point desired, but it is not able to handle porous paper, at least not without problems.

Another shortcoming of the device of German Pat. No. 1,945,501 is the fact that due to the inherent stiffness of paper it does not permit the continuous turning of sheets which are of a small format and are closed either at the top or the bottom.

Furthermore, the opening devices according to German Patent Publication No. 1,099,988, as well as those described in German Pat. No. 1,945,501, are limited as to the amount by which the sequencing speed can be increased since the opening process of one opening station has to be completed before the next proof sheet can be taken.

SUMMARY OF THE INVENTION

This invention has the purpose of creating a method and a device of the aforementioned nature which is capable of processing all possible layers of paper and kinds of paper regardless of their size, and which is also capable of significantly increasing the sequencing speed.

In accordance with the process of the present invention, a folded proof sheet which is to be opened is guided along blown air suction devices whereby the free area of the outer edges of the sheets is lifted by the suction effect of the blown air and is thus separated from the remainder of the proof sheet. The separated portion of the sheet is then guided away from the next blown air device and a new sheet can be sucked up.

It is advantageous if the proof sheets are transported along the air suction device corner first; the opening occurs at the corner of the proof sheet. Another new characteristic of the present invention is that the proof sheets pass the blown air suction devices in an imbricated fashion. It is further advantageous if the angle of separation amounts to 15°.

Apparatus in accordance with a preferred embodiment of the present invention includes a conveyor which transports the folded stack of proof sheets along devices which are lined up in order to separate the individual parts of the proof sheets up to the opening point. The mechanism for causing the separation of the parts of the sheets consists of blown air suction plates which are arranged sidewise in relation to the sheet transport area. The suction areas of these plates are positioned at a slight angle in relation to the sheet trans ɔrt area of these plates. The sheet transport areas are ɥuipped with blown air jets which produce a suction fect which is aimed at the free portions of the sheets. nmediately behind these suction plates are sheet di-ɜrters which divert the separated portion of the sheet om the influence of the next blown air suction plate. he blown air suction plates may be wedge-shaped and .e sheet diverters may be the backs of subsequent air ıction plates or dividing points in front of these plates. urthermore, it is advantageous if the blown air jets are a position counter to the direction in which the sheets ·e moving, e.g. they point in the direction of the corner hich is to be opened and they leave the suction area at ı angle of approximately 15°. The blown air jet open-gs can also be sloped downward. Apparatus in accor-ınce with a preferred embodiment of the present in-ɜntion is also characterized by the fact that the paper eder in connection with the conveyor device is posi-ɔned at an angle so that the proof sheets enter the ɔnveyor device corner first.

This process and the equipment as described for this .vention utilizes the hydrodynamic paradox which :ovides a relatively simple manner of quickly and ıfely opening folded proof sheets and which is able to ɔen all kinds of proof sheet folds, regardless of the type ? paper used.

BRIEF DESCRIPTION OF THE DRAWING

The present invention may be better understood, and ɜ numerous objects and advantages will become appar-ıt to those skilled in the art, by reference to the accom-ınying drawing wherein like reference numerals refer ı like elements and the several figures and in which.

DESCRIPTION OF THE PREFERRED EMBODIMENT

The device for the opening of folded proof sheets 1 ɔnsists primarily of a conveyor device 2 and a number ? blown air suction devices 3 positioned along the ɔnveyor device holding the proof sheets.

The closed proof sheets 1 are fed into the conveyor ɜlts which hold the sheets tightly from a drum 4 which ıs not been further described because it is a rather miliar piece of equipment. This drum is positioned at ı angle in front of the feeding device; it feeds the proof ıeets with their backs up and corner first and thus they ·e moved along the blown air suction devices. The ɜquencing speed can be significantly increased if the roof sheets are positioned in an imbricated fashion. urthermore, this type of diagonal transport permits the rocessing of all kinds of paper folds since the proof ıeets are opened from the corner.

Figure 3:
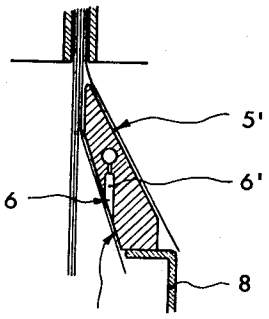
FIG. 3 is an enlarged cross-sectional view, taken ong line A-B of FIG. 2, of a blown air suction device hich may be employed in the present invention.

As illustrated particularly clearly in FIG. 3, the de-ices for the opening of the proof sheets consist of ·edge-shaped blown air suction plates located at the de of the conveyor area of the proof sheets 1 and ıounted on a supporting plate 8. The blown air suction lates each have a suction area 5 which is directed ɔward the corner of the sheet to be opened, and which at an angle of 15° with respect to the axes of a row of blown air jets 6, which are connected to a compressed air source w. .ch is not shown. When passing the blown air suction plates the outer part of the layer is sucked in the direction of area 5 and diverted by approximately 15° due to the so-called hydrodynamic paradox. In order to bring a portion of the next proof sheet within the range of the blown air of a subsequent suction plate, the first sheet which was separated is guided to the area behind the next blown air suction plate, e.g. onto its rear side 5'. For this purpose there are in front of the suction plates, with the exception of the first one, diverter devices in the form of dividing wedges 7.

Figure 1:
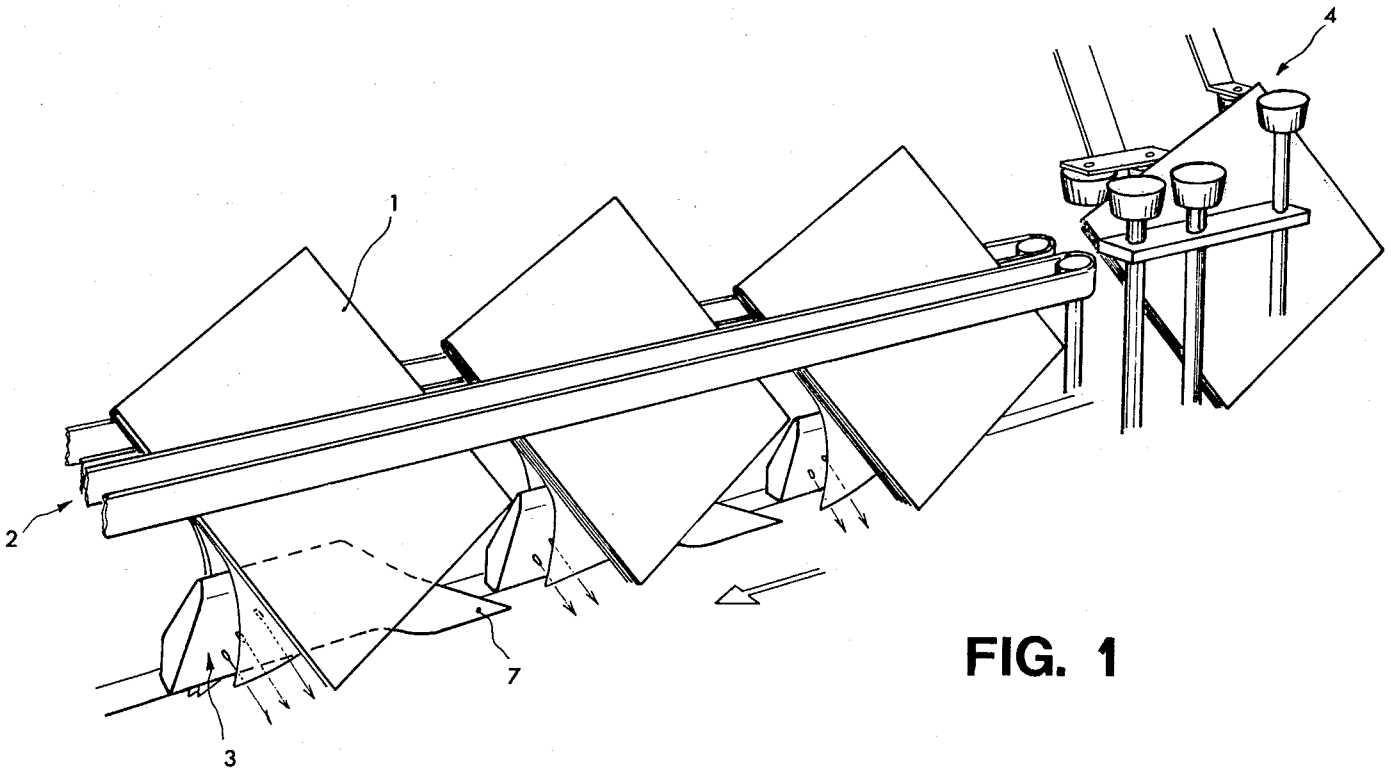
FIG. 1 is a schematic perspective view of a portion of ɔparatus in accordance with a preferred embodiment ? the present invention.
Figure 2:
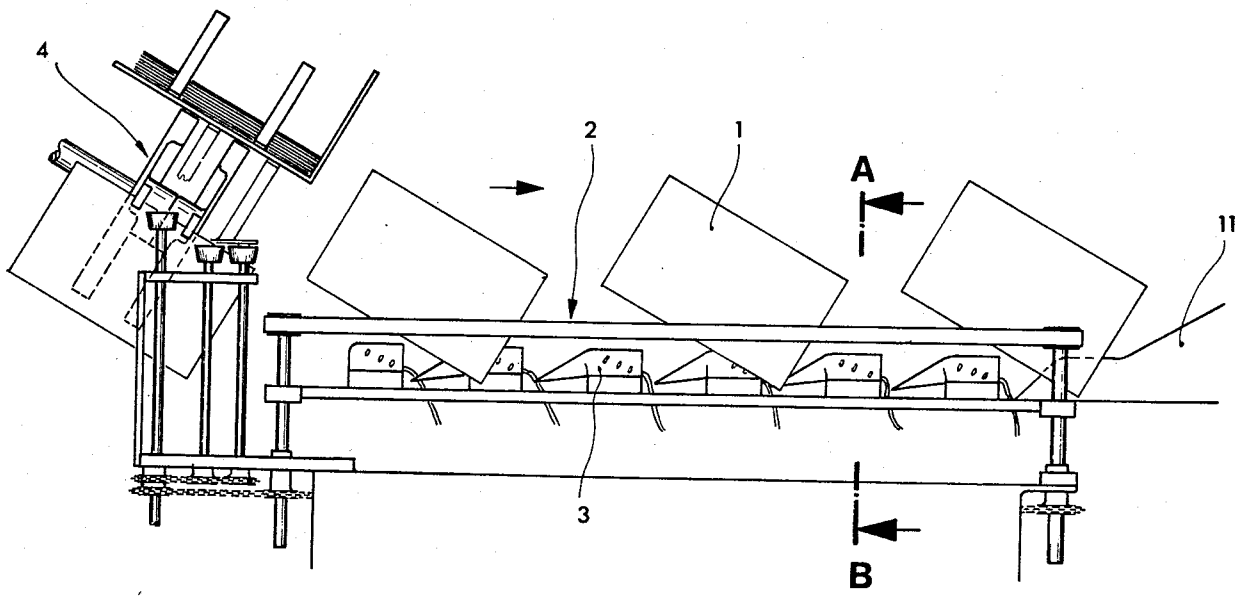
FIG. 2 is a side elevation view of a smaller version of ıe apparatus of FIG. 1.

The position of the jet openings 6 in the suction plates is indicated by a broken line which represents the outgoing air stream. The jet openings are directed counter to the direction the proof sheets are moving and the direction of the edge to be opened; i.e., downwardly and to the rights as the apparatus is shown in FIG. 1. As noted above, the jet openings are also at an angle of 15° in relation to the suction area 5, as can be seen in FIG. 3, which produces an optimal blow-suction effect. Furthermore, the jet openings 6 are arranged in a rising line counter to the direction in which the sheets are moving, which permits a gradual separation of the outer portion of the proof sheet all the way to its corner, beginning at the first jet opening closest to the proof sheet. This arrangement of the openings requires a minimum of blown air.

In order to prevent jet deflection, which occurs in openings placed at an angle, and to prevent a whirling motion as well, recessed portions 6' are provided about the jet openings.

In order to process varying formats of proof sheets, the conveyor device, can be equipped with a familiar device which need not be described here, which can be used to adjust the height of the conveyor to correspond to that of the paper feeder.

If a folded proof sheet, and this includes all kinds of folds, is to be placed in a straddled position on the plate 11 of a thread stitching machine, then the still closed sheet is moved by the conveyor device 2 along the first blown air suction device and the first outer edge is separated by the blow-suction effect from the rest of the proof sheet. In the subsequent transport, the first separated sheet is guided with the aid of the dividing wedge of a subsequent blown air suction device behind the said subsequent suction device.This enables a second outer sheet portion to enter the suction range of the following blown air suction device in order to be separated by it and to be diverted by the next blown air suction device.

Thus the individual proof sheet parts are leafed open one after another till they reach the point where all are opened and the stack is fed onto the collating plate.

The invention described herein is not limited to the example given here, although this is the preferred method. Without changing the major characteristics of this invention, the blown air suction plates can be arranged parallel to the sheet conveyor area, and they can be moved over each time after a sheet has been gripped. Furthermore, a setup is possible which has blown air suction devices on both sides of the conveyor device whereby parts of the sheets can be simultaneously separated to both sides.

What is claimed is:

1. A method for serially separating the pages of signatures composed of folded rectangular sheets which have been stacked one within the other to form a substantially planar stack or sheets comprising the steps of:

preparing the stack for transport along a predetermined pathway by placing the stack of folded sheets in a generally vertical orientation substantially parallel to the direction of transport;

said preparing step further including the step of positioning one of the corners of the stack lower than the remaining corners;

transporting the rotated vertical stack of folded sheets along said predetermined pathway;

establishing pressurized gas streams at a plurality of spacially separated locations along the predetermined pathway, the gas streams being aimed so as to at least pass partly adjacent to said one corner of the stack of folded sheets;

conveying the vertical stack of folded sheets past a first gas stream whereby the flow of the first stream will produce a lifting force and the outermost sheet will be at least partially separated from the remaining sheets;

catching the outermost sheet while it is partially separated from the remaining sheets;

guiding the caught sheet away from the remaining sheets;

passing a second gas stream between the caught sheet and the remaining sheets whereby the flow of the second stream will produce a lifting force which will act upon the next outermost sheet in the stack;

repeating the steps performed on the first sheet on the second and subsequent sheets to serially separate sheets from the moving stack; and removing the stack of sheets from the pathway once the desired number of sheets have been separated from the stack.

2. The method of claim 1 further comprising positioning the sheets in an imbricated fashion to form the stack.

3. The method of claim 1 wherein the step of transporting comprises supporting the stack of folded sheets on a conveyor.

4. The method of claim 3 wherein the step of supporting on a conveyor comprises placing the stack between a pair of closely spaced oppositely revolving belts.

5. The method of claim 1 wherein a plurality of generally parallel gas streams are established at each of the separated locations.

6. The method of claim 5 wherein the plural gas streams at each location are originated at positions spaced in a vertically descending order in the direction of stack motion along the path.

7. Apparatus for serially separating the pages of signatures composed of rectangular folded sheets which have been stacked one within the other to form a substantially planar stack of sheets comprising:

positioning means, said positioning means orienting the stack of folded sheets in a generally vertical condition with one corner lower than the remaining corners, transporting means, said transporting means receiving the stack of folded sheets from said positioning means, said transporting means retaining the stack of folded sheets in the same orientation as received from said positioning means, said transporting means carrying the stack of folded sheets along a designated pathway with said lower corner defining a leading edge of the moving stack;

at least a first separator means, said separator means being positioned along said pathway of said transporting means, said separator means providing an outwardly directed pressurized stream of gas, said stream of gas having an angular relationship to the stack of folded sheets and being directed to at least partly pass adjacent to said stack, said stream of gas producing a pressure differential between inside and outside sheet surface which acts on the said lower corner of the stack of folded sheets whereby the outermost sheet of said stack is caused to move toward the stream as said outermost sheet moves relative to said separator means; and at least one diverter means, said diverter means being positioned along said pathway of said transport means downstream of said separator means in the direction of stack travel, said diverter means catching the outer sheet of the stack which has moved toward said stream of gas of said separator means, said diverter means mechanically diverting said outermost sheet from the remaining sheets.

8. The apparatus of claim 7 wherein said separator means is a wedge shaped body, said wedge shaped body having an angled surface facing said pathway of said transporting means, said angled surface diverging away from the stack from the top to the bottom thereof.

9. The apparatus of claim 8 wherein said separator means includes a plurality of gas supply passages within said wedge shaped body, said gas supply passages each having a first diameter at their discharge ends and discharging gas into first ends of respective cylindrical chambers, said cylindrical chambers having a diameter which is greater than that of said gas supply passages discharge ends, said chambers each further having a second discharge end defined by an aperture within said angled surface of said separator means.

10. The apparatus of claim 9 wherein said cylindrical chambers are formed within said wedge shaped body, said chambers being angularly offset in a vertically descending order in the direction of stack movement.

11. The apparatus of claim 10 wherein said apparatus includes at least two of said separator means positioned along said pathway and wherein said deflector means is a wedge shaped extension of the wedge shaped body of the second of said separator means, said extension being located between said separator means.

12. The apparatus of claim 11 wherein said transporting means comprises:

a first rotating belt; and a second rotating belt, said second rotating belt rotating oppositely to said first rotating belt, said second rotating belt being closely spaced to said first rotating belt.

13. The apparatus of claim 9 wherein said apparatus includes at least two of said separator means positioned along said pathway and wherein said deflector means is a wedge shaped extension of the wedge shaped body of the second of said separator means, said extension being located between said separator means.

14. The apparatus of claim 8 wherein said apparatus includes at least two of said separator means positioned along said pathway and wherein said deflector means is a wedge shaped extension of the wedge shaped body of the second of said separator means, said extension being located between said separator means.

15. The apparatus of claim 7 wherein said transporting means comprises:

a first rotating belt; and a second rotating belt, said second rotating belt rotating oppositely to said first rotating belt, said second rotating belt being closely spaced to said first rotating belt.

* * * * *